US005372384A

United States Patent [19]

Smith

[11] Patent Number: 5,372,384

[45] Date of Patent: Dec. 13, 1994

[54] SKI-TURN SIMULATOR

[76] Inventor: David R. Smith, P.O. Box 1052, Milton, N.H. 03851

[21] Appl. No.: 203,360

[22] Filed: Mar. 1, 1994

[51] Int. Cl.[5] ..... A63C 5/00; A63C 5/06

[52] U.S. Cl. ..... 280/842; 280/11.28; 280/87.042

[58] Field of Search ..... 280/11.115, 11.14, 11.15, 280/11.28, 87.041, 87.042, 809, 842, 263, 265, 266

[56] References Cited

U.S. PATENT DOCUMENTS

| | | | |
|---|---|---|---|
| 3,436,088 | 4/1969 | Kunselman | 280/842 |
| 3,856,321 | 12/1974 | Solymosi | 280/842 |
| 3,862,763 | 1/1975 | Ware | 280/11.28 |
| 4,120,510 | 10/1978 | Hillard | 280/11.28 X |
| 4,133,546 | 1/1979 | Rosenblum | 280/842 |
| 4,134,600 | 1/1979 | McDonald et al. | 280/842 X |
| 4,235,448 | 11/1980 | Thomas | 280/842 |
| 4,353,566 | 10/1982 | Mohlenbrock | 280/842 X |
| 4,384,731 | 5/1983 | Webb | 280/87.042 X |

FOREIGN PATENT DOCUMENTS

| | | | |
|---|---|---|---|
| 0800880 | 7/1936 | France | 280/842 |
| 2569120 | 2/1986 | France | 280/11.28 |

*Primary Examiner*—Brian L. Johnson

*Attorney, Agent, or Firm*—Robert G. Crooks

[57] ABSTRACT

A wheeled simulator for enabling the practice of ski turns on "dry land." In particular, both edging of the simulated skis and preferential weighting of the "outside" simulated ski contribute to tightening of the turn to prevent a fall by the user.

7 Claims, 4 Drawing Sheets

SKI-TURN SIMULATOR

BACKGROUND OF THE INVENTION

1. Field of the Invention

This invention relates generally to a training and recreation device for enabling the simulation of ski turns on a "dry-land" slope devoid of snow or ice.

The art of skiing on snow has passed through a large number of stages of development. In each stage, the proposer of a new technique would advocate the adoption of that technique as superior to earlier techniques in one or more respects. Perhaps the proposed new technique would enable the skier to eope with more adverse conditions of the ski terrain of snow and ice. Or perhaps the development of a new item of ski equipment has made feasible a new technique which would not have been feasible without the aid of the newly-developed item of equipment. Conversely, proposed new techniques have led to the development and reduction to practice of appropriate items of equipment without which the technique would not have been fully feasible.

As is well known, there have been many different concepts concerning the proper location of the center of gravity of the body of the skier along the line parallel to the longitudinal axis of the skis and several feet above it. At one time, it was universally accepted that the center of gravity of the skier's body should be well forward with respect to the position where the skier's feet rested on the skis. Later, some very successful skiers suggested that the center of gravity of the skier's body might well be positioned aft of the location of the skier's feet on the skis.

Just as there have been numerous concepts concerning the proper location of the center of gravity of the skier's body in a fore-and-aft direction, there have also been numerous theories as to where the center of gravity of the skier's body should be located in a transverse direction, normal to the longitudinal axis of the skis.

In the very highly-developed technique that was taught in the Alps of Europe in the 1950's, a skier "traversing" the slope of a hill or trail in a diagonal direction with respect to the fall line of the hill should be "facing down the fall line" with his shoulders positioned along a line transverse and perpendicular to the fall line. The body of the skier was to be flexed so that the rear side of the skier's midsection would be pointing "uphill," while the center of gravity of the skier's body would be positioned roughly above the "downhill ski" as the traverse maneuver was executed. Under those circumstances, it was important for most of the weight of the skier's body to be borne by the downhill ski.

When the skier approached the point on the slope where he wished to execute a turn, he would bend his knees slightly, and then straighten his legs, whereby the tails of the skis were somewhat "unweighted". With the tails of the skis unweighted, the skier would then thrust his heels in a direction "up the hill" while concurrently shifting his body weight "down the hill". In order for the shift of body weight downhill not to result in a fall by the skier, it was necessary for the thrust of the skier's heels to initiate a turn of the skis, so that the front tips of the skis began to assume a position directly beneath the skier's body in its downwardly-shifted position. As the tips of the skis "came around", thereby bringing about the execution of a smooth turn, the weight of the skier's body was centered forward of his feet but not so far forward as the tips of his skis. Thus, the force transmitted from the forebodies of the skis through the skier's feet and legs to his center of gravity prevented the skier from "falling downhill." As the skier completed his smooth turn, he assumed a new traverse position crossing the slope in the opposite direction, his weight being centered over his downhill ski. Once again, most of his weight was supported by the downhill ski. And further, the skier assumed a new position in which he was still facing downhill with his shoulders positioned along a line perpendicular to the fall line, and in which the backside of his body was again pointing uphill. During the turn, the "uphill ski," before the turn, became the "downhill ski" after the turn. Correspondingly, the downhill ski prior to the turn became the uphill ski after the turn. Prior to the turn, the uphill ski was positioned slightly ahead of the downhill ski. Then, when the skis exchanged identities as between uphill and downhill, the former downhill ski became the new uphill ski and was positioned slightly ahead of the new downhill ski.

Many of the principles of the technique just described remain valid in the techniques that are now being taught in the ski schools of the 1990's. For instance, it is still regarded as important for the center of gravity of the skier's body to be positioned roughly over the "downhill ski" at all times. But the techniques being taught at the present time put more emphasis on the "carving" of a smooth turn than did the European technique described above. The carving of a smooth turn depends upon two particular physical characteristics of the ski. One of those characteristics is the flexibility of the ski about an axis transverse to the ski and passing through the point where the skier's foot rests upon the ski. Another characteristic of the ski which is important in the execution of the current technique is the fact that the width of the forebody of the ski between the skier's foot and the tip of the ski and the width of the afterbody of the ski between the skier's foot and the taft of the ski are both somewhat greater than the width of the ski at the point where the skier's foot rests upon it. Thus, proceeding from the tip toward the taft of the ski, the width of the ski first broadens sharply and then gradually narrows as one approaches the "waist" of the ski where the skier's foot is attached to it by bindings. Then, continuing in an aft direction, the width of the ski broadens again as the taft of the ski is approached. This configuration of the width of the ski might be referred to as "tapering toward the middle."

The flexibility of the ski and the configuration "tapering toward the middle" are the structural characteristics which permit the execution of the ideal "carved" turn. As the turn is executed, the ski, which in rest position and unweighted has a "camber" so that the midpoint of the ski is higher than the forebody and the afterbody, during the carving of the turn temporarily assumes an "inverse camber." The weight and centrifugal force imposed upon the waist of the ski during the turn force the ski into the configuration of an are which is coincident with the desired path of the carved turn in the snow.

Clearly, the foregoing statements are based upon an assumption that the planes of the bottoms of the respective skis are not oriented parallel to the surface of the snow, but are inclined at a sharp angle thereto. Depending upon the stage within the turn, the angle of inclination might be as much as 45°, or perhaps even more in a very "tight" turn. Of course, the angle of inclination with respect to the surface of the snow would be less when the turn is being completed than at the stage when the sharpest turning activity is occurring. Again, the nature of the snow terrain would influence the degree of "edging" of the skis with respect to the snow. If the surface of the snow is icy, the skis would in all probability be more drastically edged with respect to the terrain than of the surface were "fluffy powder."

During the foregoing discussion, the importance of maintaining the center of gravity of the skier's body over the downhill ski has been stressed. Moreover, it has been emphasized that the weight of the skier's body should be borne mainly through the foot which rests on the downhill ski. Clearly, the two skis are "differentially weighted" at almost all times. We have not yet referred to any "differential edging" of the two skis with respect to the surface of the terrain.

In the earlier discussion of the prior favored technique, it was mentioned that the tails of the skis were partially unweighted in order to initiate a turn. This unweighting of the skis involved a forward shift of the center of gravity of the skier's body. In the most recently favored technique, there is more emphasis on the shift of the center of gravity of the skier's body in a direction "down the fall line," rather than forward over the skis. As the skier's body weight is shifted "down the fall line," it is clear that the skier must take some action in order to prevent himself from "falling down the fall line." That action is the initiation of the turn which brings about a re-positioning of the tips of the skis in the direction of the turn, so that the skier's weight can be supported by the forebodies of the skis, thereby preventing a fall by the skier. The farther down the fall line the center of gravity of the skier's body is shifted, the more rapidly the skis must execute the "carved turn" in order that the forebodies of the skis may assume a position under the center of gravity of the skier's body so as to support it. The faster and farther the skier's body is shifted in a direction down the fall line, the more rapidly the turn must be executed. Bringing about a more rapid execution of the turn in most instances will involve a sharper edging of the skis, and a dissimilar weighting of the skis in order to impose maximum burden on the ski which is on the outside of the turn being carved. Accordingly, the ski on the inside of the turn, which is to become the "uphill ski" after the completion of the turn, may bear very little of the weight of the skier's body.

When good snow conditions are available, and when a skier is properly equipped, the technique just mentioned can be taught and learned "on the slope." However, when a suitable slope with favorable ski conditions is not available, it becomes important to have access to a training device which can simulate the aforementioned conditions so as to enable the skier to develop and maintain good skiing habits in the practice of the new technique. For instance, if a skier desires to develop, maintain, or refine his skills "between seasons," a "ski simulator" would be very valuable. If such a simulator were available, the "off-season skier" would need only a gently sloping surface of pavement upon which to use his simulator. The factors that the practicing skier must focus on and properly coordinate are: 1) the lateral shift of the center of gravity of his body in a "downhill" direction; 2) the proper coordinated "edging" of his feet to simulate the way in which his skis would be edged during the execution of a turn; and 3) the differential weighting placed upon the two feet in order to simulate the differential weighting of the skis on a snow surface. Once again, a foot which is the "downhill foot" prior to the turn and accordingly bears a disproportionate part of the skier's weight becomes the Uphill foot after the completion of the turn and is relieved from bearing some or all of the skier's weight.

2. Description of the Prior Art

Until now, there has been no available device that satisfactorily simulates the execution of a ski turn "on dry land." The familiar "skateboard" will not suffice, either with or without modifications. Skateboards are designed so that the feet of the user are oriented at least partially transversely upon the body of the skateboard. The user of the skateboard causes the board to turn one way or the other depending upon whether he accentuates the weight placed upon his heels or upon his toes. The linkage of the skateboard is such as to produce a turn thereof when one side of the body of the board is weighted more heavily than the other. The skateboard is designed in such a way that it will turn in a direction toward the side of the board which is more heavily weighted than the other. Clearly, for a skier who needs to learn to weight preferentially his "outside foot," a skateboard is exactly the "wrong way to go."

U.S. Pat. No. 4,235,448-Thomas is entitled "Skiing Simulator," but, like a skateboard, seems to be based upon the wrong assumption concerning the distribution of the weight of the skier. The mechanism of the cited patent is such that the "skateboard-type" platform upon which it is based will turn toward the side thereof that is more heavily weighted. This is directly contrary to the principles set forth in the foregoing paragraphs describing the two techniques, one earlier, and the other, the latest. Moreover, the structure of the Thomas patent is such that the soles of the feet of the user of the Thomas simulator are always in the same plane. As has been made clear in the foregoing paragraphs, the respective feet of a skier executing either of the described techniques on snow terrain are almost always in different planes. Those planes may on occasion be parallel to each other, or need not be parallel, but in any event they are not the same plane. Thus, the apparatus in accordance with the Thomas patent is not an adequate device for the simulation of real skiing conditions or the practice of either of the aforementioned ski techniques. Furthermore, there seems to be no other prior-art device or disclosure which does permit valid simulation of skiing conditions or the practice and development of proper ski technique.

OBJECTS OF THE INVENTION

Accordingly, it is an object of the present invention to provide a training device which allows a skier to practice and refine his ski technique when a snow-covered terrain is not available. Once again, the training device should enable the skier to coordinate the three aforementioned components of up-to-date ski technique as follows: 1) shift of body weight in a direction transverse to the direction of progress of the device; 2) preferential weighting of the foot which represents the "downhill foot," with a gradual shift during the turn as the foot which represents the "outside foot" during the turn becomes the downhill foot after the completion of the turn; and 3) separate "edging" of the two feet to simulate the independent edging, in parallel or non-parallel planes, which is a characteristic of skiing by means of either of the aforementioned techniques.

It is another object of the invention to provide a training device which is rugged, simple, and as economical as possible. The device should, to the extent feasible, use commercially-available components.

SUMMARY OF THE INVENTION

Briefly, I have been able to accomplish the aforementioned objectives by providing a device built on an elongated body which constitutes the "backbone" of the device. On each side of the body is disposed a footrest for one of the feet of the user of the device. The feet of the user are to be disposed parallel to the longitudinal axis of the elongated body of the device. Transverse to the body are a pair of cross members, oriented normal to the longitudinal axis of the body, for carrying the aforementioned footrests. Attached to the underside of the body are a pair of skateboard-type "trucks," one forward and one aft. Appropriate linkages are provided for turning the trucks and their axles in response to differential weighting of the footrests and to the edging of the footrests by the feet of the user.

BRIEF DESCRIPTION OF THE DRAWINGS

The invention summarized above will be described in detail in the following specification. The specification will be best understood if read while referring to the accompanying drawings in which.

DETAILED DESCRIPTION OF THE PREFERRED EMBODIMENT

Figure 1:
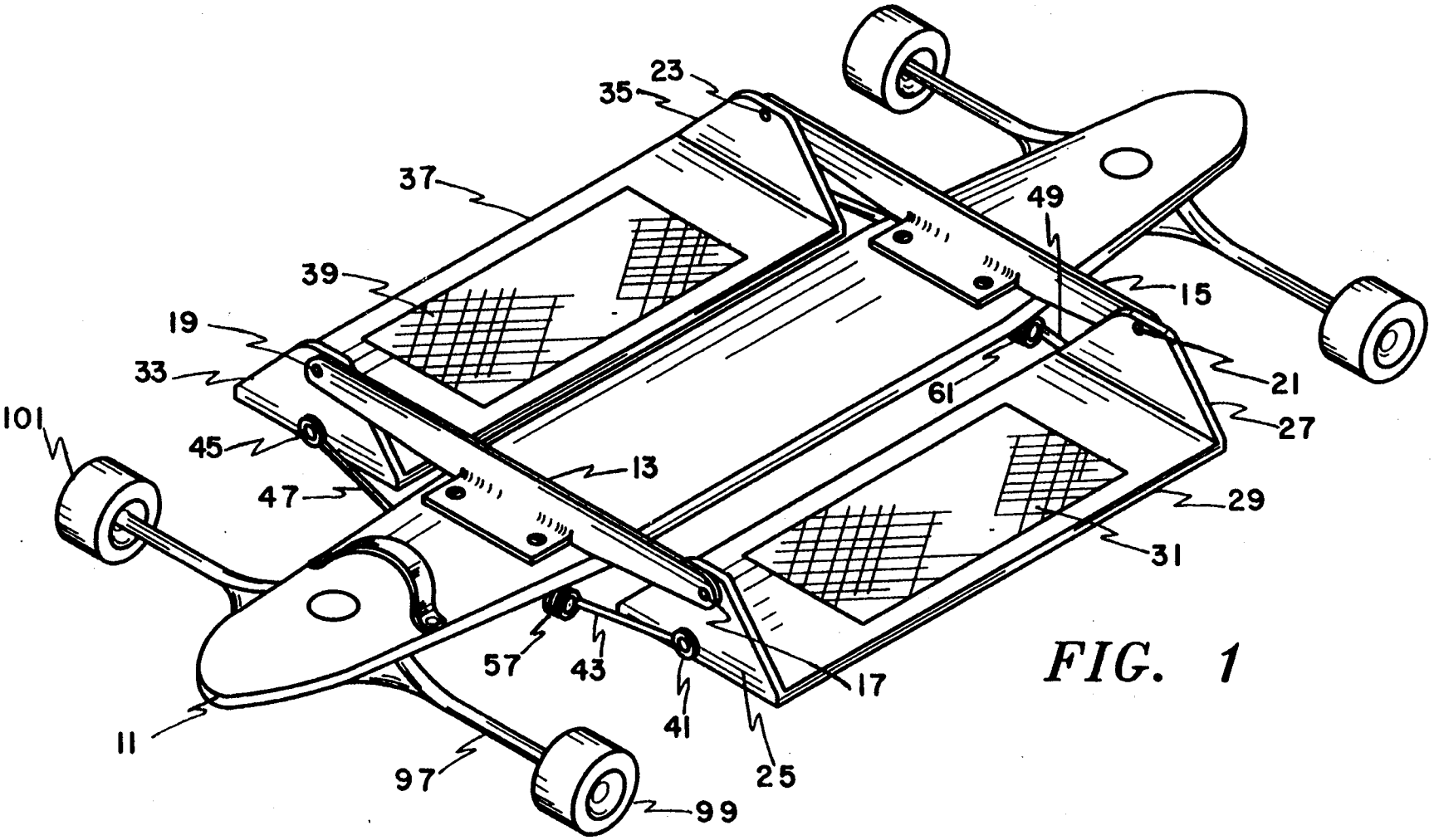
FIG. 1 is a perspective view of the ski-turn simulator of my invention taken from above and from one side of the simulator.

Turning to FIG. 1 of the drawings, we see in perspective a representation of one form of the ski-turn simulator in accordance with this invention. An elongated body 11 carries a first cross member 13 and a second cross member 15, which may be fastened to elongated body 11 by any suitable rigid means, or may be formed integrally therewith. I prefer to construct elongated body 11 of fiberglass-reinforced plastic material, but it may alternatively be made of any other light, strong, and rigid material. If not formed integrally with elongated body 11, first cross member 13 and second cross member 15 may be formed of aluminum or other strong, light metallic material. If so formed, the cross members may be fastened to elongated body 11 by screws or other suitable fasteners.

Near the respective ends of first cross member 13 are a first pivot 17 and a second pivot 19. Near the respective ends of second cross member 15 are a third pivot 21 and a fourth pivot 23. First pivot 17 and third pivot 21 respectively support a first endplate 25 and a second endplate 27 of a first footrest 29. Once again, first endplate 25 and second endplate 27 may be fastened to first footrest 29, or may be formed integrally therewith. If desired, first footrest 29 may be equipped with a first mat 31.

Second pivot 19 and fourth pivot 23 respectively support a third endplate 33 and a fourth endplate 35 of a second footrest 37, which is similar in structure to first footrest 29 but is positioned on the opposite side of elongated body 11 therefrom. Once again, if desired, second footrest 37 may be equipped with a second mat 39 or other device to prevent slippage of the user's foot on the footrest.

Fastened to first endplate 25 by a first pin 41 is a first linking member 43, which may be formed from a light but relatively stiff material such as steel "music wire" approximately 0.080 inch in diameter. First linking member 43 may be formed into an eyelet surrounding first pin 41 so as to permit rotational relative motion between first linking member 43 and first endplate 25. Similarly, a second pin 45 secures a second linking member 47 to third endplate 33 in such a way as to permit relative rotational motion between second linking member 47 and third endplate 33. Further, a third linking member 49 and a fourth linking member 51 are pinned to second endplate 27 and fourth endplate 35 respectively by pins which are not visible in FIGS. 1 and 2 of the drawings.

The ends of first linking member 43, second linking member 47, third linking member 49, and fourth linking member 51, respectively, which are remote from the ends thereof pinned to the endplates of the footrests, may be bent at right angles or otherwise formed so as to pass through respective holes in a first tang 53 of a first steering member 55. First tang 53 and first steering member 55 may be formed integrally from a slab of strong material having a plan view resembling that of a ping-pong paddle. First linking member 43, second linking member 47, third linking member 49, and fourth linking member 51 may have formed therein, respectively, a first coil 57, a second coil 59, a third coil 61, and a fourth coil 63. If, as suggested, the linking members are formed from wire having a diameter of approximately 0.080 inch, the outside diameter of the coils may desirably be approximately ½ inch. Typically, the coils would be formed with fewer than ten circular turns.

Figure 2:
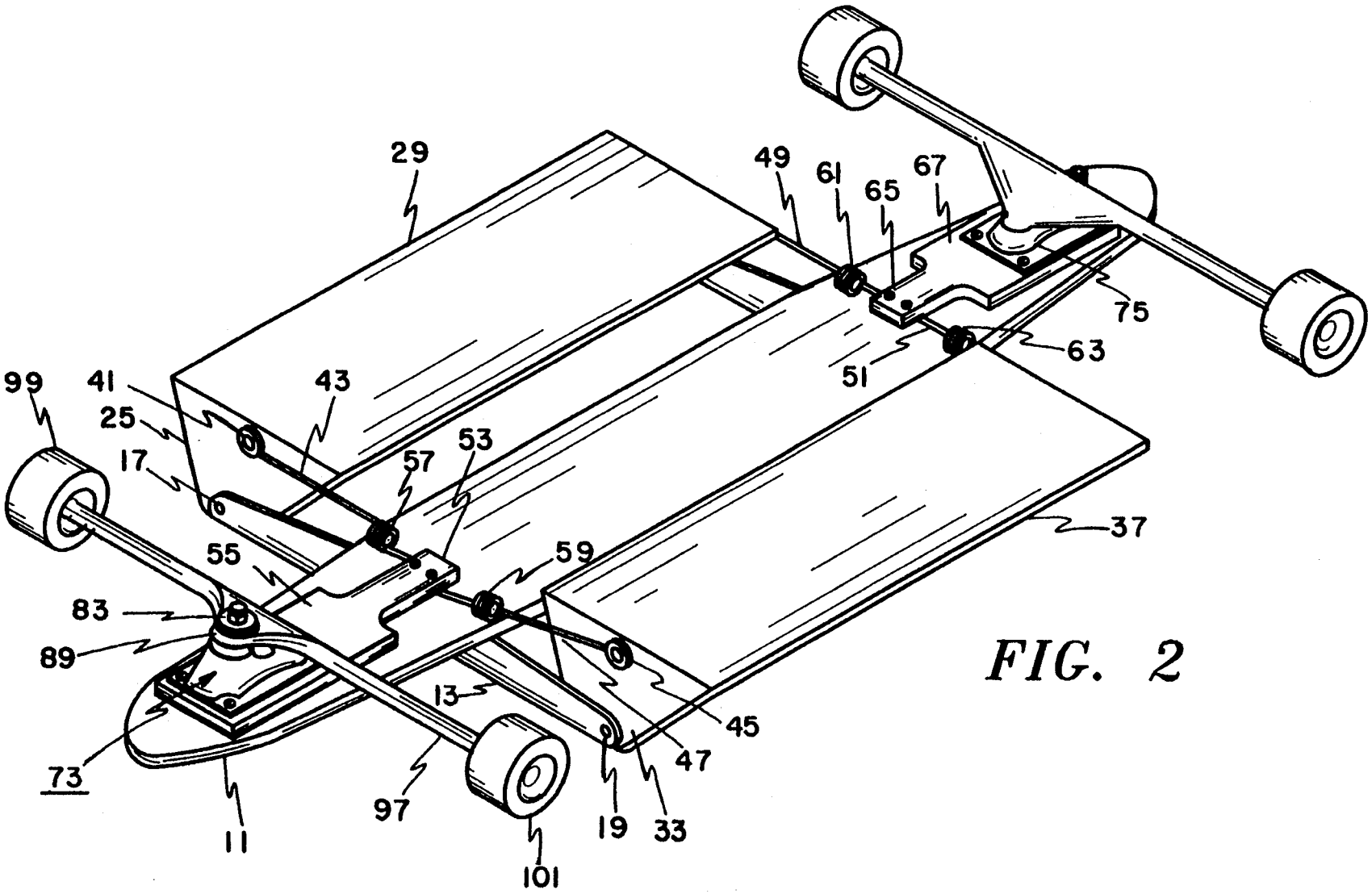
FIG. 2 is a perspective view of the ski-turn simulator of my invention taken from below and from one side of the simulator.
Figure 3:
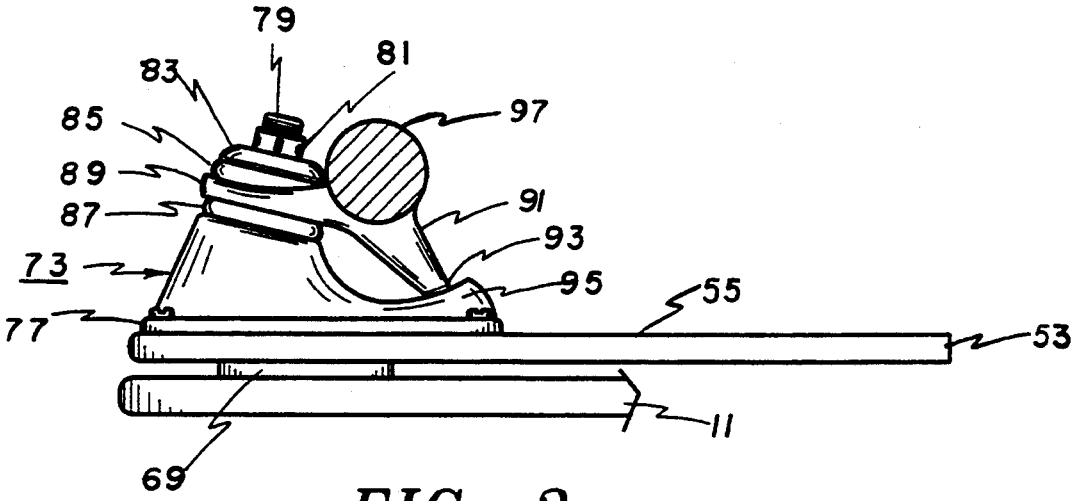
FIG. 3 is a side view, partly in section, of one of the "trucks" of the simulator, showing how the truck is mounted on a steering member which, in turn, is carried on one face of a flat bearing whose other face is attached to the undersurface of the elongated body of the simulator.

As illustrated in FIG. 2 of the drawings, first tang 53 and first steering member 55 may have as counterparts second tang 65 and second steering member 67, located near the opposite end of elongated body 11. As shown in FIG. 3 of the drawings, first steering member 55 is coupled to elongated body 11 through a first fiat bearing 69. Second steering member 57 may be similarly coupled to elongated body 11 through a second fiat bearing, not visible in the drawings. Accommodated near the respective ends of elongated body 11 are a first "truck" 73 and a second truck 75, each of which comprises a number of components which will now be described in detail. If desired, first truck 73 and second truck 75 may be configured similarly or identically to commercially-available skateboard trucks. Although the trucks in themselves may be commercially available, the way in which they are mounted and employed for the fulfillment of the objectives of this invention is anything but conventional.

As aforementioned, first steering member 55 and second steering member 67 should be coupled to elongated body 11 through first flat bearing 69 and second flat bearing respectively. It is important that first steering member 55 and second steering member 67 be capable of rotational motion with respect to elongated body 11. However, the steering members should preferably not be capable of rocking motion with respect to elongated body 11. In other words, the coupling of the respective steering members to elongated body 11 should be strong, as through a strong metal shaft, and should hold the respective steering members parallel to the surface of elongated body 11, while permitting rotational relative motion of each steering member with respect to the undersurface of elongated body 11.

The rotational motion of first steering member 55 with respect to elongated body 11 is produced by means of the forces exerted on first tang 53 by first linking member 43 and second linking member 47. Each of those linking members should be relatively stiff so as to be able to "push" as well as to "pull." The purpose of the coils formed in the respective linking members is to permit a small amount of compliance while preserving sufficient stiffness to enable the linking member to "push" on the tangs of the respective steering members as well as to pull on them. The ends of the respective linking members, after having been bent at approximately a right angle and passed through respective holes in the tangs of the steering members, may be pinned to retain them in position, while permitting rotation of the end of each linking member within its respective hole in the tang. The opposite ends of the respective linking members may, if desired, be formed into eyelets for embracing respectively first pin 41, second pin 45, and the corresponding pins mounted in second endplate 27 and fourth endplate 35 respectively.

It is now timely to point out that first footrest 29 and second footrest 37 serve the following three purposes:

1. Obviously, the footrests support the weight or the user of the ski-turn simulator as transmitted thereto through the left and right feet of the user respectively. As will be apparent from FIG. 1 of the drawings, the left and right feet are oriented on opposite sides of elongated body 11 and are to be positioned substantially parallel to the longitudinal axis of elongated body 11.

2. When first footrest 29 and second footrest 37 are unequally weighted by the user, they transmit through first cross member 13 and second cross member 15 a force tending to rock elongated body 11 about its longitudinal axis. The structure of the respective trucks, permitting such rocking motion of elongated body 11 about its longitudinal axis will be explained in the following paragraphs.

3. The mounting of the endplates of the respective footrests on first pivot 17, second pivot 19, third pivot 21, and fourth pivot 23 permits each footrest to swing, somewhat in the fashion of a pendulum, about the pivots at its respective endplates. When the user of the simulator "edges" or inclines his feet about a fore-and-aft axis, the endplates of the respective footrests exert, through the four linking members, forces on first tang 53 of first steering member 55 and second tang 65 of second steering member 67, tending to rotate those steering members about the shafts through which they are coupled to elongated body 11 through first flat bearing 69 and second flat bearing 71 respectively. Thus, whereas unequal weighting of the footrests produces rocking motion of elongated body 11 about its longitudinal axis, edging of the footrests causes rotation of the steering members about the shafts through which they are coupled to elongated body 11.

Figure 4:
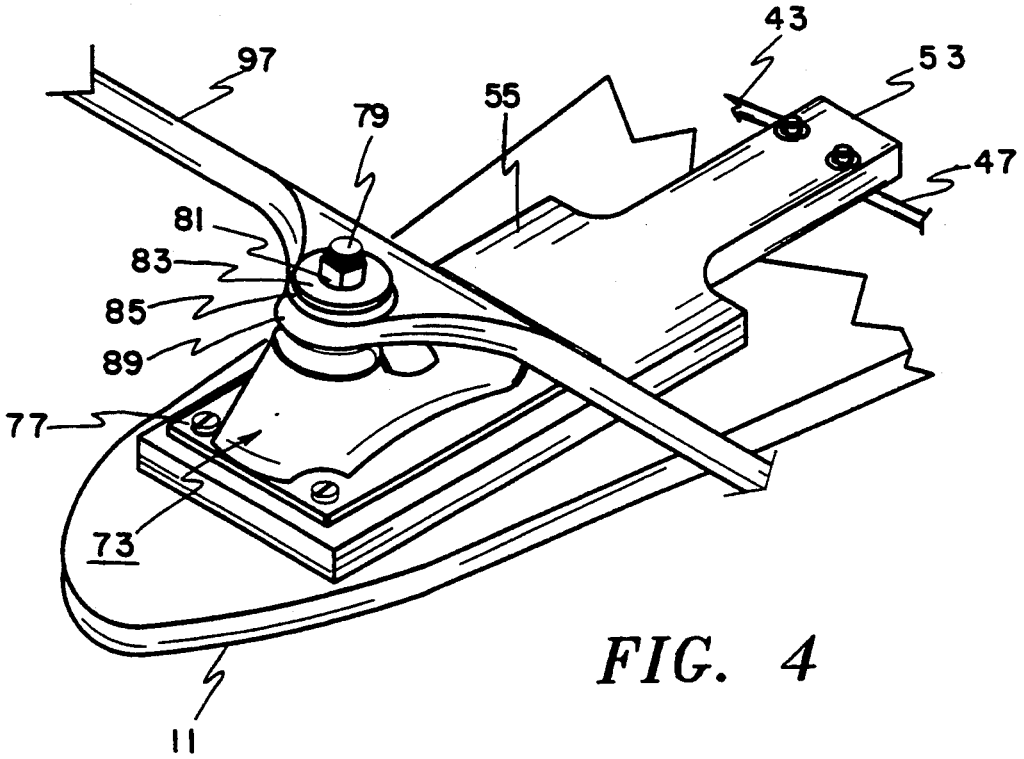
FIG. 4 is a perspective view, partly broken away, showing the mounting of one of the trucks on a steering member coupled to the undersurface of the elongated body, with the aforementioned flat bearing interposed between the steering member and the elongated body but concealed by the steering member.
Figure 5:
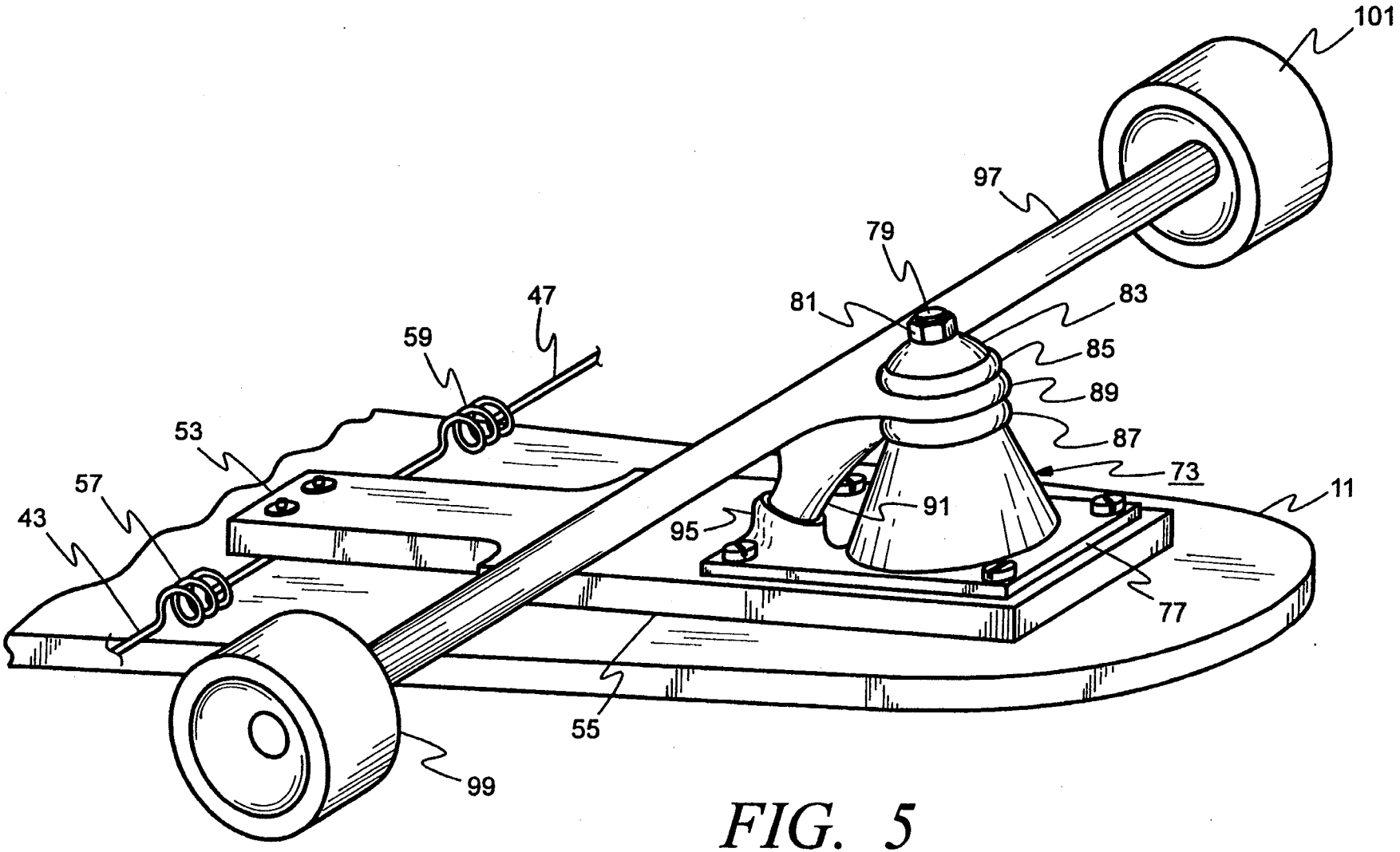
FIG. 5 is another perspective view showing the mounting of one of the trucks on a steering member coupled to the undersurface of the elongated body, but including the wheels on the axles and clarifying the way in which a ball on an arm of the truck is seated in a socket on the mounting plate of the truck.

Referring to FIG. 3, FIG. 4, and FIG. 5 of the drawings, it is apparent that first truck 73, and correspondingly, second truck 75, each include a mounting plate by which they are firmly fixed at or near respective ends of the steering members remote from the tangs thereof. A mounting plate 77 is illustrated in FIG. 5 of the drawings. Mounting plate 77 may be formed integrally with a metal casting or other principal structure of first truck 73. An important component of first truck 73 is a stud or similar bolt-like member 79 which passes downwardly through the hollow casting of first truck 73 and through mounting plate 77 and first steering member 55, and is set firmly in elongated body 11, so that any rocking motion of elongated body 11 about its longitudinal axis will cause stud 79 to swing correspondingly.

A nut 81 may be screwed onto the end of stud 79 in order to hold in place a clamping ring 83 which bears on a first resilient ring 85, that may be made from rubber or some other very durable elastic material. A second resilient ring 87 is supported atop the casting structure of first truck 73. Between first resilient ring 85 and second resilient ring 87 is embraced a rigid ring 89 which is formed at one end of an arm 91, rigid ring 89 and the remainder of arm 91 being preferably formed out of a single piece of metal. At the end of arm 91 remote from rigid ring 89 is formed a ball 93 which is received in and accommodated by a socket 95 or similar depression in the metallic structure of mounting plate 77 or the casting of first truck 73. The confinement of ball 93 within socket 95, which in turn is fixed directly or indirectly to mounting plate 77, ensures that rigid ring 89 can have only motion which is essentially circular about an axis passing through the center of ball 93. Rigid ring 89 can move from side to side over first steering member 55, but cannot move substantially in a fore-and-aft direction parallel to the longitudinal axis of first steering member 55 and of elongated body 11.

Connected rigidly to arm 91 is an axle 97 at the respective ends of which are journalled a first wheel 99 and a second wheel 101. Of course, axle 97 does not rotate about its own axis, but supports first wheel 99 and second wheel 101 through the medium of roller or ball bearings that ensure the free movement of those wheels with respect to axle 97. Axle 97 may be rigidly attached to arm 91, as shown in FIG. 3. Alternatively, axle 97 may be formed integrally with arm 91 and with rigid ring 89, as illustrated in FIG. 4 of the drawings.

A full understanding of the operation of the ski-turn simulator of this invention will be facilitated by considering the simulator to be placed upon the ground, right side up, as shown in FIG. 1 of the drawings, with its wheels 99 and 101, and the corresponding wheels of the second truck, resting upon the ground. The firm contact between those wheels and the ground constrains the truck so that it cannot rotate about the longitudinal axis of elongated body 11. However, as has been observed in foregoing paragraphs, unequal weighting by the user placed upon first footrest 29 and second footrest 37, transmitted to elongated body 11 through first cross member 13 and second cross member 15, causes elongated body 11 to rotate or rock about its own longitudinal axis. When it does so, stud 79, which is rigidly attached through an opening in first steering member 55 to elongated body 11, rocks with it. As it does so, it applies, through first resilient ring 85 and second resilient ring 87, a torque to rigid ring 89, embraced between first resilient ring 85 and second resilient ring 87. As has been explained, rigid ring 89 can move from side to side, but only about an axis centered over ball 93 at the other end of arm 91. Thus, when stud 79 is caused by the rocking of elongated body 11 to swing like a pendulum, the force which it transmits through first resilient ring 85 and second resilient ring 87 to rigid ring 89 causes axle 97 to rotate, with the wheels at its ends, about a center of rotation determined by the rotation of ball 93 within socket 95. Hence, rocking of elongated body 11 about its longitudinal axis, as caused by unequal weighting of first footrest 29 and second footrest 37, forces axle 97 to rotate about the center of ball 93. This is one component of the turning action of the ski-turn simulator in accordance with this invention.

The other component of the turning action of the simulator is brought about by the rotation of first steering member 55 with respect to elongated body 11, such rotational relative motion taking place in planes parallel to the respective top and bottom surfaces of first flat bearing 69. When first footrest 29 and second footrest 37 are edged by the user of the simulator, the linking members, acting through first tang 53 of first steering member 55, cause rotation thereof, with respect to elongated body 11, about the shaft connecting first steering member 55 to elongated body 11. When first steering member 55 rotates, it carries with it mounting plate 77, the main casting of first truck 73, and socket 95 in which ball 93 is confined. Thus, the center of rotation of axle 97 is itself translated in a crosswise direction with respect to the longitudinal axis of elongated body 11.

Reference to FIG. 3 of the drawings will make clear the composite effect of rotation of first steering member 55. At the same time, stud 79 is "rocking" by reason of the rocking motion of elongated body 11. If the upper extremity of stud 79, as seen in FIG. 3, is visualized as moving out of the plane of the paper of FIG. 3, and if, at the same time, the center of ball 93, confined in socket 95 in mounting plate 77 of first truck 73, is visualized as translating into the plane of the paper of FIG. 3 due to the rotation of first steering member 55 about its axis of mounting upon elongated body 11, it becomes apparent that the resultant turning action of axle 97 is approximately equal to the sum of the respective turning actions by the rocking of stud 79 and the rotation of first steering member 55 about its axis on elongated body 11. This additive effect is very significant in the operation of the ski-turn simulator.

It has been observed and explained that the turning action of axle 97, which is coupled to first truck 73, is the sum of two component turning effects, the first attributable to unequal weighting of the first and second footrests, and the other attributable to edging of those footrests by the user of the simulator. A further additive turning effect is produced because, as is shown in FIG. 1 and FIG. 2 of the drawings, substantially identical trucks, axles, and wheel pairs are furnished at both ends of elongated body 11. While it is not absolutely necessary to have turning action at both ends of the simulator, it becomes clear that the effective turning action is substantially doubled if the components which have been described are duplicated at the respective ends of elongated body 11. Thus, the total effective turning action is the sum of four components. It is not essential that the trucks and their components at both ends be identical. However, there is no particular reason to make them different. There is no reason for the simulator to have a "front end" and a "back end." The direction of operation of the simulator need not assume any particular importance.

Having explained the various mechanical components of the simulator, let us now relate the functions of those components to the desired training as spelled out in the introductory paragraphs of this specification. We have observed that in the performance of a traverse maneuver across a ski slope, or in the later stages of a turn, the majority of the skier's weight should be borne by the "downhill" ski. In the use of the simulator, such unequal weighting placed upon the respective footrests causes elongated body 11 to rock and thereby causes stud 79 to transmit through first resilient ring 85 and second resilient ring 87 to rigid ring 89 a turning torque which is thence transmitted through axle 97 to the wheels of the simulator. The materials from which the resilient rings are manufactured should be such as to furnish compliance while remaining undamaged by the constant transmission of such force therethrough.

As we have observed, when a skier executes a turn, he edges almost from the beginning of the turn. Thus, the skis are inclined at an angle with respect to the surface upon which the skis are travelling. That effect is realistically duplicated by the simulator. When the footrests are not only differentially weighted, but also inclined at an angle with respect to the surface upon which the simulator is travelling, the linking members apply force to the tang of the steering member, such force being converted into a torque that causes the steering member, carrying the entire mechanism of the truck, to be rotated with respect to the lower surface of elongated body 11. The material of first flat bearing 69 should be nylon or TEFLON or some other smooth material capable of permitting such relative motion without suffering damage thereto. Thus, superimposed upon the turning torque applied to the axle through rigid ring 89 is a second turning torque applied to first steering member 55 which rotates the entire truck assembly. Although these two torques are not directly additive, the turning effect produced upon the axle thereby is additive. This additive nature of the two turning effects is very important in the functioning of the simulator in accordance with my invention.

As has been explained in great detail, it is important in developing proper ski technique to combine and coordinate the effects produced respectively by differential weighting and by edging, whether the edging of the respective skis happens to be equal or unequal. The simulator provides a means for coordinating in a desired fashion the differential weighting and the edging in order to produce a composite turning effect that combines the results which would be obtained from each of differential weighting and edging taken separately.

In addition to the differential weighting and edging effects, it has further been explained that a transverse shift of the center of gravity of the skier, or the user of this simulator, is of great importance in developing proper ski technique. That transverse shift of the center of gravity must be appropriately coordinated with the effective sum of the turning effects produced by the differential weighting and edging as has been described. If it is not so coordinated, the skier, or the user of this simulator, will fall. Thus, the simulator in accordance with this invention affords the user the opportunity to adjust the shift of his body weight in such a way as to coordinate it with the sum total of the turning effects produced by differential weighting and by edging of the respective footrests. This constitutes a fulfillment of the principal objective of my invention.

In addition to fulfilling the objectives of my invention, I have achieved an advantage which may not be readily apparent without discussion. It may be described as follows: As the user of the simulator transfers the center of gravity of his body farther and farther "downhill", he leans farther and farther "into the turn." Accordingly, he becomes more and more unbalanced unless he is able to "tighten up the turn" sufficiently to prevent himself from falling. In tightening up a turn on snow terrain, a skier would normally edge his skis more and more sharply with respect to the snow surface. In using the simulator in accordance with the present invention, he takes a similar action. But instead of edging his skis more and more sharply, he edges the footrests more and more sharply. As he does so, the force which his body exerts on the footrests may be resolved into components which are primarily transverse, rather than perpendicular to the surface. When the turn is tightened, and the skis become more sharply edged, or the footrests become more sharply edged in the case of this simulator, the centrifugal-force component becomes larger and larger compared with the component of force normal to the surface on which the simulator is running. Therefore, the imbalance between the weight forces exerted on the footrests and tending to "roll" the body of the simulator about its longitudinal axis becomes less significant. As the roll of the body about its longitudinal axis decreases, the force exerted against rigid ring 89 and thence transmitted to axle 97 to cause turning thereof decreases. Just when the user needs more turning action to tighten up his turn, this particular component of turning torque on the axle of the truck is no longer present to the degree that is needed. Surprisingly, with my simulator, when the need for turning action is greatest, the edging of the footrests with respect to the running surface is maximized.., thereby transmitting through the linking members to the steering member the maximum amount of force. So, when turning action is most urgently needed, steering member 55 forces the assembly of mounting plate 77 and stud 79 to rotate about a vertical axis, thereby adding that component of turning action to the component transmitted through the rigid ring and the arm to the axle.

It will be recalled from elementary statics theory that, when the footrests are inclined at an angle of 45°, the forces applied to the footrests and having a component tending to cause roll of the body are reduced by a factor of the square root of two divided by two. Assuming linearity of operation, if the roll of the body is reduced by a factor of the square root of two divided by two, the turning torque applied by the rigid ring through the arm to the axle is likewise reduced by a factor of the square root of two divided by two. At this very time, when the footrests are inclined or edged at an angle of 45° or more, the turning actions provided by the force of the linking members on the steering member are maximized and make up the deficiency caused by the decrease in turning torque applied to the axle by the rigid ring through the arm.

As any experienced skier will understand, the accurate simulation of snow-skiing conditions can be achieved only if the simulation device is capable of tightening up its turns when the edging effort is increased, as indeed takes place when a smoothly carved turn is executed by skis on a satisfactory snow surface. The foregoing discussion has demonstrated that the simulator in accordance with the present invention is capable of so doing, and therefore is a very realistic training device.

The preceding disclosure sets forth fully the most-favored embodiment of my invention known to me at the time of filing of my application. Recognizing that certain changes therein may be made by others without departing from the scope of the invention, I set forth my invention in the following claims which, with their equivalents, are desired to be secured hereby.

What I claim as new and desire to secure by Letters Patent of the United States is as follows:

1. A ski-turn simulator comprising:

(a) an elongated rigid body having two ends and a principal axis therebetween, (b) first and second cross members attached to said elongated rigid body and extending laterally therefrom on both sides, (c) first and second footrests carried by said first and second cross members and pivotally connected thereto for rocking motion about respective axes substantially parallel to said principal axis of said elongated rigid body, (d) first and second trucks coupled to said elongated rigid body at respective locations displaced from each other along said principal axis, each of said trucks including an axle member extending laterally from said elongated rigid body on each side thereof, (e) a steering member for at least one of said trucks, said truck being mounted on said steering member and said steering member being pivotally connected to be rotatable about an axis perpendicular to said elongated rigid body and said steering member having a portion extending parallel to said principal axis of said elongated rigid body, and (f) means linking said respective first and second footrests to said extending portion of said steering member so that said rocking motion of said first and second footrests is coupled to said extending portion of said steering member to cause rotational motion of said steering member about said axis perpendicular to said elongated rigid body.

2. A ski-turn simulator in accordance with claim 1 in which said elongated rigid body has a rigid ring that is coupled elastically to one of said first and second trucks so that rocking motion of said elongated rigid body about the principal axis causes rotational motion of said truck about said axis perpendicular to said elongated rigid body.

3. A ski-turn simulator in accordance to claim 2 in which the rotational motion of said truck about said axis perpendicular to said elongated rigid body is the total of that which is caused by said rocking motion of said first and second footrests and that which is caused by said rocking of said elongated rigid body about the principal axis.

4. A ski-turn simulator comprising:

(a) an elongated rigid body having two ends and a principal axis therebetween, (b) first and second cross members attached to and extending laterally from said elongated rigid body on both sides thereof, (c) first and second footrests carried by said first and second cross members and pivotally connected thereto for rocking motion about respective axes substantially parallel to said principal axis of said elongated rigid body, (d) first and second trucks coupled to said elongated rigid body at respective locations displaced from each other along said principal axis, each of said trucks including an axle member extending laterally from said elongated rigid body on each side thereof, said coupling being effective to rotate said axle member about an axis perpendicular to said principal axis in response to rocking motion of said elongated rigid body about said principal axis, (e) a steering member for at least one of said trucks, said truck being mounted on said steering member and said steering member being pivotally connected to be rotatable about an axis perpendicular to said elongated rigid body and said steering member having a portion extending parallel to said principal axis of said elongated rigid body, and (f) means linking said respective first and second footrests to said extending portion of said steering member so that said rocking motion of said first and second footrests is coupled to said extending portion of said steering member to cause rotational motion of said steering member about said axis perpendicular to said elongated rigid body.

5. A ski-turn simulator in accordance with claim 4 in which said axle member has a wheel journalled through bearings at each end thereof.

6. A ski-turn simulator in accordance with claim 4 in which each of said first and second tracks is coupled to said elongated rigid body through a rigid ring and at least one resilient ring.

7. A ski-turn simulator in accordance with claim 4 in which each of said linking means includes a coil for imparting appreciable compliance thereto.

* * * * *